US009976255B2

(12) United States Patent
D'Agnone

(10) Patent No.: US 9,976,255 B2
(45) Date of Patent: May 22, 2018

(54) COMPOSITION OF FIBROUS MATERIAL

(71) Applicant: Uwe D'Agnone, Hennef (DE)

(72) Inventor: Uwe D'Agnone, Hennef (DE)

( * ) Notice: Subject to any disclaimer, the term of this patent is extended or adjusted under 35 U.S.C. 154(b) by 412 days.

(21) Appl. No.: 14/384,187

(22) PCT Filed: Mar. 11, 2013

(86) PCT No.: PCT/EP2013/054885
§ 371 (c)(1),
(2) Date: Sep. 10, 2014

(87) PCT Pub. No.: WO2013/135632
PCT Pub. Date: Sep. 19, 2013

(65) Prior Publication Data

US 2015/0068693 A1 Mar. 12, 2015

(30) Foreign Application Priority Data

Mar. 13, 2012 (DE) ..... 20 2012 002 588 U
Aug. 6, 2012 (DE) ..... 10 2012 107 193
Oct. 1, 2012 (DE) ..... 10 2012 109 306

(51) Int. Cl.
*D21H 11/12* (2006.01)
*D21H 11/14* (2006.01)
*D21J 1/00* (2006.01)

(52) U.S. Cl.
CPC ..... *D21H 11/12* (2013.01); *D21H 11/14* (2013.01); *D21J 1/00* (2013.01)

(58) Field of Classification Search
CPC ..... D21H 11/12
See application file for complete search history.

(56) References Cited

U.S. PATENT DOCUMENTS

614 A * 2/1838 Sanderson ..... D21C 3/222 162/75
1,876,221 A * 9/1932 Grunder ..... C08L 97/02 156/308.6
6,027,610 A 2/2000 Back et al.
(Continued)

FOREIGN PATENT DOCUMENTS

CN 2012-50366 Y 6/2009
CN 101934286 A * 1/2011
(Continued)

OTHER PUBLICATIONS

Smook, Handbook for Pulp and Paper Technologists, 1992, Angus Wilde Publications, 2nd edition, chapters 2, 13, 15, and 16.*
(Continued)

*Primary Examiner* — Anthony Calandra
(74) *Attorney, Agent, or Firm* — Douglas Denninger

(57) ABSTRACT

The present invention relates to a fibrous material composition having a predefined fraction of fresh fibres and/or waste paper with a further fraction of sweet grass, sedge, seagrass and/or algae fibres and adjuvants and water, where the weight fraction of sweet grass, sedge, seagrass and/or algae fibres is greater than 1 and less than 100 wt. % of the total material mass, in each case calculated as oven-dry material fraction. The invention further relates to a method for producing the fibrous material mixture and its use for producing fibrous-material-containing products.

19 Claims, 6 Drawing Sheets

Variables in the Production of Grass Paper

(56) References Cited

U.S. PATENT DOCUMENTS

| | | | | |
|---|---|---|---|---|
| 6,348,127 | B1 * | 2/2002 | Gallagher | D21C 1/10 162/18 |
| 2003/0030693 | A1 | 2/2003 | Kawano et al. | |
| 2011/0297343 | A1 | 12/2011 | Li et al. | |

FOREIGN PATENT DOCUMENTS

| | | | | |
|---|---|---|---|---|
| CN | 2013-80023446.X | | 9/2015 | |
| EP | 2402504 | A1 | 1/2012 | |
| GB | 543972 | | 3/1942 | |
| WO | WO-2009-140808 | A1 | 11/2009 | |
| WO | WO 2012010181 | A1 * | 1/2012 | D21B 1/02 |

OTHER PUBLICATIONS

Alloegue et al., Mechanical properties of Posidonia oceanica fibers reinforced cement, Journal of Composite Materials, vol. 49(5), p. 509-517.*

ITIS Report, Ammophilia, 2010 [downloaded online Dec. 5, 2016].*

Derwent Summary of CN101934286, dated Jan. 5, 2011.*

* cited by examiner

Table 1

| | Thickness and Air Permeability | | Tear Strength [mJ/m] | | E-Modules [N/mm²] | | Breaking Force [N] | | Elongation [%] | |
|---|---|---|---|---|---|---|---|---|---|---|
| | Thickness [um] | Air Permeability [ml/min] | Length | Width | Width | Length | Width | Length | Width | Length |
| Test 1 | 189 | 571 | 1367 | 1743 | 1148 | 2861 | 22 | 62 | 0.018 | 0.023 |
| Test 2 | 134 | 299 | 1460 | 1790 | 1407 | 3469 | 23 | 58 | 0.024 | 0.025 |
| Changes in % | | | | | | | | | | |
| Test 1 | 100 | 100 | 100 | 100 | 100 | 100 | 100 | 100 | 100 | 100 |
| Test 2 | 71 | 52 | 107 | 103 | 123 | 121 | 104 | 94 | 135 | 110 |

Fig. 10

Table 2

| | Test 1 | Test 2 |
|---|---|---|
| L* | 72.08 | 73.00 |
| a* | 1.86 | 1.86 |
| b* | 18.24 | 18.39 |
| WG ISO [%] | 30.68 | 31.70 |
| COLORATION | 0.04 | 0.04 |
| OPACITY [%] | 99.58 | 99.94 |

Fig. 11

COMPOSITION OF FIBROUS MATERIAL

CROSS-REFERENCE TO RELATED APPLICATIONS

This application is a national phase filing under 35 USC § 371 of international application No. PCT/EP2013/054885 filed 11 Mar. 2013, which claims priority to German Application Nos. 20 2012 002 588.0 filed 13 Mar. 2012, 10 2012 107 193.4 filed 06 Aug. 2012, and 10 2012 109 306.7 filed 01 Oct. 2012. The entire contents of each of the above-mentioned applications are incorporated herein by reference.

FIELD OF THE INVENTION

The present invention relates to a fibrous material composition, in particular for use to produce paper, board, card, print substrates, isolating or insulating material, fibre boards, filler material, and a method for producing such a fibrous material mixture.

BACKGROUND OF THE INVENTION

Fibrous material mixtures are known in the prior art. For this purpose, wood-containing and wood-free fibrous materials are used in the prior art, which are substantially obtained from tree-like plants. For this purpose the corresponding plants, such as tree trunks for example, are comminuted and processed either as mechanical or chemical pulp in which at least substantial parts of the lignin contained in the wood are removed. The corresponding fibrous materials are also partially adapted to the optical and mechanical requirements, for example, by means of bleach or milling and then further processed.

A disadvantage with the fibrous material compositions known in the prior art and the methods for manufacturing this is that the defibration particularly of wood, tree trunks or wood offcuts is very energy-consuming, in the production of chemical pulp appreciable process-technology expenditure and also considerable quantities of chemical adjuvants and water must be used. Furthermore, the wood to be used for this purpose must be cultivated over a relatively long period of time before it can be fed to the preparation process for producing fibres. Furthermore, relatively high expenditure on transport is required for this purpose.

SUMMARY OF THE INVENTION

Starting from this prior art for fibrous material mixtures and the manufacture thereof, it is the object of the present invention to at least partially reduce or avoid the disadvantages known from the prior art.

The object is solved by a fibrous material mixture according to claim 1 and the claimed method for producing this fibrous material mixture according to claim 8. Preferred embodiments of the fibrous material composition and the method are the subject matter of the respective subclaims. The object is further solved by the use of the fibrous material to produce products as determined by claim 16.

The fibrous material composition according to the invention has a predetermined fraction of fresh fibres and/or waste paper, which in addition to adjuvants and water, also comprises a predefined fraction of sweet grass and/or sedges and/or seagrass and/or algae fibres. The weight fraction of the sweet grass, sedge, seagrass and/or algae fibres (individually or in combination) in the fibrous material mixture lies between 1 and 100 percent by weight relative to the total material mass and is determined as the oven-dry material fraction.

For determining the oven-dry material fraction, reference is made to the relevant standards to determine material density, dry content and/or residual moisture.

Fresh fibres or waste paper are understood according to the present invention as fibrous materials selected from a group containing long fibre pulp, short fibre pulp, chemically delignified fibrous materials, sulphate pulp, sulphite pulp, pulps from the soda process or organocell process, cotton pulp, mechanical pulp, thermo mechanical pulp, groundwood pulp, chemo thermo mechanical pulp, waste paper, in particular of grades A-D: lower grades; E-J: medium grades; K-U: better grades; V-W: kraft grades and X: special grades, bleached chemical pulp, combinations thereof and the like. Here it should be borne in mind that it is also within the sense of the present invention that the aforesaid fibrous materials will be or are mechanically and/or chemically pre-treated. This comprises in particular the milling and/or the cutting of the fibres and/also the bleaching and/or the chemical grinding of these fibrous materials. The bleaching can be accomplished both oxidatively or reductively or consist of corresponding bleaching stages in combination. Furthermore, the fibrous materials can also be pre-treated enzymatically in order, for example to reduce the grinding resistance of the fibrous material.

In addition to the previously presented and determined fibrous materials, the fibrous material composition according to the invention also comprises a predefined fraction of sweet grass and/or sedge fibres. These grass fibres are preferably prepared from dried, partially dried or fresh grass, where the grass is preferably selected from a group which includes spike grasses, meadow grasses and spiked meadow grasses as well as sedges of the genera poaceae and cyperaceae, in particular grasses of the subfamilies anomochlooideae, pharoideae, puelioideae, bambusoideae, ehrhartoideae, pooideae, such as, for example, tribus aveneae, tribus poeae, tribus, triticeae aristidoideae, danthonioideae, arundinoideae, chloridoideae, centothecoideae, panicoideae, such as, for example, *saccarum officinarum* and micrairoideae and in particular *agrostis canina*—brown bent; *agrostis capillaris*—common bent grass; *agrostis stolonifera*—black bent grass; *agrostis vinealis*—brown bent; *aira caryophyllea*—silver hairgrass; *aira praecox*—early hair grass; *alopecurus geniculatus*—bent foxtail; *alopecurus myosuroides*—annual foxtail; *alopecurus pratensis*—field meadow foxtail; *ammophila arenaria*—beach grass; *anthoxanthum aristatum*—annual vernal grass; *anthoxanthum odoratum*—common sweet vernal grass; *apera spica-venti*—common wind grass; *arrhenatherum elatius*—tall oat grass; *avena fatua*—common wild oat; *avena sativa*—common oat; *brachypodium pinnatum*—for grass; *brachypodium sylvaticum*—false brome; *briza maxima*—blowfly grass; *briza media*—common quaking grass; *bromus arvensis*—field brome; *bromus benekenii*—rough brome; *bromus carinatus*—mountain brome; *bromus commutatus*—meadow brome; *bromus erectus*—erect brome; *bromus hordeaceus*—lopgrass; *bromus inermis*—Arctic brome; *bromus madritensis*—Mediterranean brome; *bromus secalinus*—rye brome; *bromus sterilis*—barren brome; *bromus tectorum*—cheatgrass; *calamagrostis arundinacea*—rough small reed; *calamagrostis epigejos*—wood small reed; *catapodium rigidum*—fern grass; *coix lacryma-jobi*—tear grass; *cortaderia selloana*—Pampas grass; *corynephorus canescens*—silver grass; *cynodon dactylon*—couch grass; *cynosurus cristatus*—crested dog's tail;

*dactylis glomerata*—orchard grass; *danthonia decumbens*—heath grass; *deschampsia cespitosa*—tussock grass; *deschampsia flexuosa*—wavy hair grass; *deschampsia setacea*—bog hair grass; *digitaria ischaemum*—smooth crabgrass; *digitaria sanguinalis*—hairy crabgrass; *echinochloa crus-galli*—common barnyard grass; *echinochloa muricata*—hispid barnyard grass; *elymus caninus*—bearded couchgrass; *elymus repens*—quackgrass; *eragrostis albensis*—Elbe lovegrass; *eragrostis curvula*—curved lovegrass; *eragrostis minor*—lesser lovegrass; *eragrostis multicaulis*—Japanese lovegrass; *festuca arundinacea*—tall fescue; *festuca filiformis*—slender fescue; *festuca gigantea*—tall bearded fescue; *festuca pratensis*—meadow fescue; *festuca rubra*—red fescue; *glyceria fluitans*—floating sweetgrass; *glyceria maxima*—reed sweetgrass; *glyceria maxima*—reed sweetgrass; *helictotrichon pratense*—meadow oatgrass; *helictotrichon pubescens*—downy alpine oatgrass; *helictotrichon pubescens*—downy alpine oatgrass; *holcus lanatus*—fog grass; *hordelymus europaeus*—wood barley; *hordeum jubatum*—foxtail barley; *hordeum murinum*—false barley; *hordeum vulgare*—common barley; *koeleria macrantha*—crested catstail; *koeleria pyramidata*—pyramidal catstail; *lolium multiflorum*—annual ryegrass; *lolium perenne*—perennial ryegrass; *lolium remotum*—flaxfield ryegrass; *lolium temulentum*—cockle; *melica ciliata*—hairy melic; *melica nutans*—mountain melic; *melica uniflora*—wood melic; *milium effusum*—millet grass; *miscanthus floridulus*—sword grass; *miscanthus sacchariflorus*—silver grass; *miscanthus sinensis*—Chinese silver grass; *miscanthus sinensis 'variegatus'*—Chinese silver grass; *miscanthus sinensis 'variegatus'*—Chinese silver grass; *molinia arundinacea*—tall moor grass; *molinia caerulea*—purple moor grass; *nardus stricta*—nard grass; *panicum capillare*—witchgrass; *panicum miliaceum*—common millet; *panicum riparia*—stream-side common millet; *pennisetum setaceum*—red fountain grass; *pennisetum villosum*—feathertop grass; *phalaris arundinacea*—ribbon grass; *phalaris canariensis*—Canary grass; *phleum phleoides*—purple stem cat's tail; *phleum pratense*—common cat's tail; *phragmites australis*—reeds; *poa annua*—annual meadow grass; *poa bulbosa*—black grass; *poa chaixii*—forest bluegrass; *poa compressa*—Canada bluegrass; *poa nemoralis*—wood meadow grass; *poa palustris*—swamp meadow grass; *poa pratensis*—bird grass; *poa trivialis*—rough meadow grass; *polypogon monspeliensis*—beard grass; *puccinellia distans*—sweet grass; *secale cereale*—rye; *sclerochloa dura*—hard grass; *setaria italica*—Chinese millet; *setaria pumila*—fox red foxtail; *setaria verticillata*—bristly foxtail; *setaria viridis*—green foxtail; *sorghum bicolor*—sorghum; *sorghum halepense*—Johnsongrass; *trisetum flavescens*—yellow oatgrass; triticale; *triticum aestivum*—common wheat; *triticum dicoccon*—amelcorn; *triticum durum—durum; triticum monoccocum*—small spelt; *triticum spelta*—spelt; *vulpia myuros*—rat's tail fescue; *zea mays*—maize, meadow grass, sport and utility grass such as, for example, *festuca, lolium perenne, poa pratensis, agrosti*, sedges of the genus *carex*, combinations thereof and the like. With these fibres it should also be borne in mind that it is also within the sense of the present invention to pre-treat the aforesaid fibrous materials. This comprises in particular the milling and/or the cutting of the fibres and/also the bleaching and/or the chemical grinding of these fibrous materials. The bleaching can be accomplished both oxidatively or reductively or consist of corresponding bleaching stages in combination. Furthermore, the fibrous materials can also be pre-treated enzymatically in order, for example to reduce the grinding resistance of the fibrous material.

Particularly preferred compositions for the sweet grass and/or sedge fibres are obtained as follows, where the corresponding compositions preferably at least comprise the said plants:

Variant 1: tall oat grass, golden oat grass, cocksfoot grass, common bent, meadow timothy.

Variant 2: maize.

Variant 3: at least one grass from a group comprising flat sedge (*Blysmus*), alkali bullrush (*Bolboschoenus*), true sedges (*Carex*), sawtooth sedge (*Cladium*), coco grasses (*Cyperus*), spike rushes (*Eleocharis*), cotton grass (*Eriophorum*), bulrushes (*Isolepis*), bog sedges (*Kobresia*), beak sedges (*Rhynchospora*), Kopfried bogrush (*Schoenus*), tule (*Schoenoplectus*), rushes (*Scirpus*), bulbous rushes (*Trichophorum*).

Variant 4: buckwheat, perennial ryegrass, tall oat grass, golden oat grass, oats, cocksfoot grass, perennial rye, annual ryegrass, meadow timothy, common meadow grass, meadow fescue.

Variant 5: sugar cane.

Variant 6: buckwheat, perennial rye, oats.

Variant 7: oats, buckwheat, perennial rye, black oats, soft wheat.

Variant 8: meadow fescue, perennial ryegrass, meadow timothy, common meadow grass, red fescue.

Variant 9: perennial ryegrass Gremie, perennial ryegrass Hübal, perennial ryegrass, red fescue, meadow timothy, common meadow grass.

Variant 10*: Festuca rubra commutata, Festuca rubra trichophylla, Poa pratensis.*

Variant 11*: Lolium perenne, Poa pratensis, Festuca rubra rubra.*

Variant 12*: Koeleria macrantha, Poa pratensis, Festuca rubra commutata.*

Variant 13*: Festuca rubra trichophylla, Festuca rubra commutata, Poa pratensis.*

Variant 14*: Festuca rubra commutata, Festuca rubra rubra, Festuca rubra trichophylla, Lolium perenne, Poa pratensis.*

Variant 15*: Festuca rubra trichoph. Festuca rubra rubra, Lolium perenne Poa, pratensis, Achillea millefolium.*

Variant 16*: Agrostis canina* or *Agrostis capillaris, Festuca ovina duriusula* or *Festuca ovina vulgaris, Festuca rubra commutata, Festuca rubra rubra, Festuca rubra trichophylla, Lolium perenne, Poa pratensis.*

Variant 17*: Agrostis canina* or *Agrostis capillaris, Festuca ovina duriusula* or *Festuca ovina vulgaris, Festuca rubra commutata, Festuca rubra rubra, Festuca rubra trichophylla, Lolium perenne, Poa pratensis.*

Furthermore in addition to or in combination with the aforesaid sweet grasses and/or sedge, seagrass or algae can also be used as so-called grass fibres which are selected from a group which inter alia includes genera seagrasses (*zostera*) and species *zostera angustifolia* (hornem.) rchb., *zostera asiatica* miki, *zostera caespitosa* miki, *zostera capensis* setch., *zostera capricorni* asch., *zostera caulescens* miki, *zostera japonica* asch. & graebn., common seagrass (*zostera marina* L.), *zostera mucronata* hartog, *zostera muelleri* lrmisch ex asch., dwarf eel-grass (*zostera noltii* hornem.), *zostera novazelandica* setch., *zostera tasmanica* m. martens ex asch., furthermore heterozostera and phyllospadix, Neptune grasses (*posidonia*) from the family posidoniaceae, cymodocea, halodule, syringodium and thalassodendron from the family cymodoceaceae and enhalus acoroides, halophila and thalassia from the family of the tape grass family (hydrocharitaceae), subfamily halophiloideae, or glaucophyta, haptophyta, maw Geiβler (cryptista), euglenozoa, dinozoa (s. dinoflagellaten), raphidophyceae (chloromonadophyceae), chlorarachniophyta, yellow-green algae (xanthophyceae), gold algae (chrysophyta), diatoms bacil/ariophyta, brown algae (phaeophyta), red algae (rhodophyta), green algae (chlorophyta), picobiliphyta, heterokontophyta, excavata, stramenopile, haptophyta, cryptophyta, chlorarachniophyta and heterokontophyta, alveolata, biliphyta combinations thereof and the like.

According to a further, particularly preferred embodiment of the present invention, in particular only the sweet grass, sedge, seagrass and/or algae fibre fraction (individually or in combination) of the fibrous material composition is prepared mechanically before mixing thereof with the other components. This comprises in particular drying, cleaning and/or cutting or milling.

In this case, in particular the sweet grass, sedge, seagrass and/or algae (directly or in combination) can be further processed directly after the cutting without drying. This should preferably be accomplished as close as possible in time to the cutting or harvesting since the fermentation process which starts otherwise inter alia results in an increased evolution of temperature, particularly if water is added during the further processing. In the case of this direct processing, it should further be noted that this is accompanied by a relatively strong green coloration in the end product (grass paper) if no further measures or process steps are taken.

Alternatively, the grass i.e. the sweet grass and/or sedge and/or seagrass and/or algae fibre can only be partially dried, where low residual moisture is also accompanied by a reduced green coloration in the end product.

Finally the grass can be dried very strongly (dry content between 75 and 90%), with the result that relatively little green colorations can be achieved in the end product.

It also lies further within the sense of the present invention that the grass is washed before the processing. This can be accomplished in one or multiple stages, where preferably water is used for this purpose, its temperature being between 10° C. and 95° C. Good results are achieved with multiple washings in the range between one and six wash cycles.

According to a further particularly preferred embodiment of the present invention, the grass is prepared by cutting and harvesting from meadow grass, sports and/or grass playing areas, where in particular for meadows the second or each further cut is particularly well suited since the tendency to knot formation is reduced here. However it is also within the sense of the present invention to supply sweet grass and/or sedge from the first cut to further processing, where the expenditure on cutting and/or grinding can optionally be further increased.

When cleaning the grass or the grass fibres, it is also within the sense of the present invention that impurities such as, for example, soil, stones, plastic etc. are removed before the further processing. This can be cleaned dry both by air separators (here for example the fibres are blown with air onto a screen whereby heavy impurities and light impurities travel a different distance from the fibres as a result of their weight and are thus separated. Alternatively in particular the dry fibres can also be cleaned by means of centrifuges. Furthermore, the fibres can also be washed for the cleaning where this can be carried by washing out and wringing in a filter. The green coloration can also be reduced in parallel through this cleaning step.

An advantage of a dry cleaning is that an optionally necessary intermediate drying can be avoided.

Furthermore, it is also within the sense of the present invention that prior to suspension the fibres are comminuted to a max. length of 15 mm, but best towards less than 1 mm in order to ensure a good processing. This process can take place in each state of the fibres, whether fresh or dry. As a result of the lower resistance then, the comminution is simplest with the dry fibres. Comminution is also possible during the milling as, for example, in the refiner and with the corresponding setting of this unit. Another possibility is also a combination of the cutting before the milling and the milling, where for example the fibres are pre-cut outside the refiner or hollander to a max. length of 50 mm and for example compressed into pellets. These pellets can then be suspended in water and after swelling thereof, further comminuted or milled in the refiner or hollander. With this possibility, inter alia a shortening of the processing time in the refiner/hollander is achieved and an associated saving of energy.

As a result of the drying to a dry content between 75 and 90%, inter alia an improved storability and an associated all-year inventory holding and paper production independent of the season are obtained. The drier the fibres, the smaller the weight that must be transported. Due to the compression during pelleting, a smaller transport volume and a shorter comminution phase in the refiner/hollander is required.

It is also within the sense of the invention when pelletizing to equip the mixing ratio of the grass with the corresponding additives such as pulp, groundwood pulp, waste paper etc. and/or by adding an adjuvant or several adjuvants and thus provide a finished mixture for the further processing.

Adjuvants according to the present invention are understood in particular as additives which are selected from a group which includes retention agents, dewatering adjuvants, retention agent dual systems or microparticle systems, wet and dry strength agents, fillers and/or pigments, in particular from a group of kaolin, talc, calcium carbonate, calcium silicate, titanium dioxide, aluminium hydroxide, silicic acid, bentonite, barium sulphate, binder components, paint components, defoamers, deaerators, biocides, enzymes, antioxidants, preservatives, bleaching agents, optical brighteners, dyes, nuancing dyes, impurity collectors, precipitants, adhesive, resin, fixing agents, wetting agents, pH regulators, binders such as starch, carboxymethylcellulose, casein, guar, soya proteins, cellulose ether, vegetable proteins of different origin, synthetic binders in dispersion form as well as water-soluble form based on styrene butadiene, styrene-(meth) acrylate esters, vinylacetetate ethylene, vinylacetate acrylate esters, vinylacetate as well as polyvinyl alcohols, cross-linking agents, viscosity regulators, optical brighteners, deaerators, pH regulators, combinations thereof and the like.

According to a further, particularly preferred embodiment of the present invention, the fraction of the weight fraction of sweet grass, sedge, seagrass and/or algae fibres (individually or in combination) is greater than 10%, in particular greater than 25% and particularly preferably greater than 50% and/or the fraction of fresh fibres and/or waste papers is less than the weight fraction of sweet grass and/or sedge fibres in the fibrous material composition.

The object of the present invention is also solved by a method for producing a fibrous material mixture, where the method comprises the steps of harvesting the sweet grass, sedge, seagrass and/or algae (individually or in combination), cutting the sweet grass, sedge, seagrass and/or algae (individually or in combination) to a predefined length, suspending the sweet grass, sedge, seagrass and/or algae (individually or in combination) in water and adding predefined fractions of fresh fibres and/or waste paper and/or adjuvants to the suspension. In the aforesaid process steps it should be borne in mind however that these can also be optionally varied in their sequence in order in particular to take into account synergy effects in the preparation of different types of fibrous material.

The method according to the invention comprises according to a further embodiment, after mowing, the step of partial drying and/or pelleting, where for this purpose the sweet grass, sedge, seagrass and/or algae fibres (individually or in combination) are preferably cut to a predefined length before the pelleting. Optionally this can be combined with the pelleting process or method.

According to a further particularly preferred embodiment of the present method, the green grass fibrous fraction is ground before the addition of fresh fibres and/or waste paper. This can be accomplished historically by a hollander or in modern times by a refiner, where by adjusting the refiner, the correspondingly treated fibrous material can be ground in a cutting and/or fibrillating manner. In particular, fibrillating grinding affords the advantage that not only the length of the fibrous material is varied but also the surface of the fibrous material is significantly enlarged with the result that the capability to form bonds between the fibres is increased and consequently the strength of the product produced is improved.

According to the preceding explanations on the fibrous material composition, it is also within the sense of the present invention that individual fibrous material components or the entire fibrous material composition is bleached, sorted, dispersed and/or homogenized, and in particular when processing to form paper, card or board, is adjusted to a predefined material density.

With regard to the shortening or the cutting of the sweet grass and/or sedge and/or seagrass and/or algae before the further processing, in particular before suspension in water, this shortening should be executed in such a manner that the length of the grass is predominantly 20 cm, in particular 10 cm, and preferably between 100 mm and 0.1 mm, particularly preferably between 50 mm and 1 mm and in particular between 10 mm and 1 mm.

It is further within the sense of the present method that in particular before cutting or further processing to a predefined length, the sweet grass, sedge, seagrass and/or algae (individually or in combination) is cleaned mechanically, in particular is cleaned or washed with air and/or water.

The object of the present invention is also solved by the use of the previously described fibrous material composition to produce paper, board, card, print substrates, isolating or insulating material, fibre boards, filler material, combinations thereof or the like.

Further aspects of the invention are obtained from the following detailed description of one possible embodiment of the invention in conjunction with the drawing and the claims. It is pointed out that modifications or additions as are deduced directly for the person skilled in the art are covered by these examples. Furthermore the preferred exemplary embodiments do not constitute any restriction of the invention so that modifications and additions also lie within the scope of the present invention.

DETAILED DESCRIPTION OF THE PRESENTLY PREFERRED EMBODIMENTS

Figure 1:
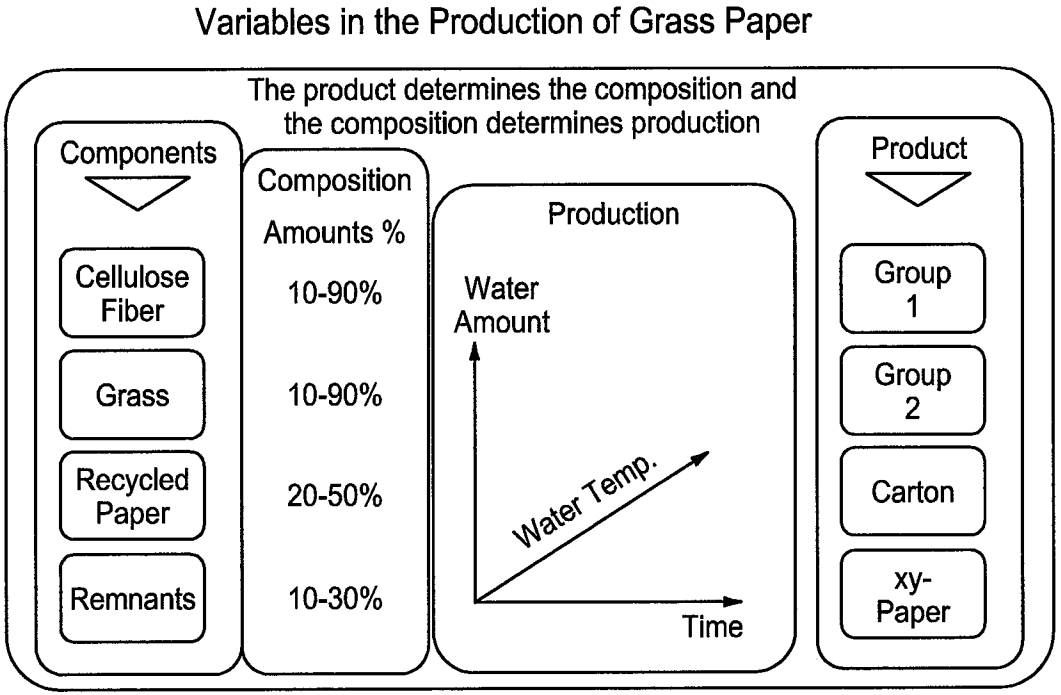
FIG. 1 is a schematic diagram for the variables in the production of grass-containing products.

In the figures:

FIG. 1 is a schematic diagram for the variables in the production of grass-containing products. Here it is shown how the fibrous material composition in its possible variations among other things influences the opacity and therefore also the classification into product groups, e.g. cardboard packaging—very opaque—large grass fraction. In the example shown here, the fibrous material composition can consist of pulp, grass fibres (grass), waste paper and material residues which are added to the fibrous material composition in different fractions. It is further shown that both the time, the amount of water and also the water temperature have a direct influence on the properties, in particular the opacity of the fibrous material composition when processing the fibrous material. The possibly substantial variation takes place during grinding where the processing time during the grinding increases with increasing sweet grass and/or sedge fraction. Schematically different groups are listed among the range of products which are determined by the respective requirement profile of the particular application and further processing.

For example, conventional meadows, lawns (sports turf, private households, cities and communities)—hereinafter only called grass—can be used to produce grass paper. In this case a plurality of grasses of the order "sweet grass like" (Poales) or "sedge-like" (Cyperaceae) can be used where for the subfamily Cyperoidorae such as, for example, coco grasses and papyrus, certain restrictions can apply. For these grasses an additional peeling must be performed during further processing. This would possibly be (energy) expensive.

When using ordinary meadow grass, the leaves present on the meadows can be co-processed without any problems. For better further processing, storage and more efficient transport, the grass can be dried (hay), freed from impurities and comminuted. A compression such as pelleting for example can also be useful here. The grass is then added without additional processing to a material suspension in the mixing ratio of, for example, 10% or placed in water. The further additives can be pulps of fresh fibres or also secondary fibres such as, for example, lumps or waste paper. These additives can also be combined.

The ratio of the fibrous material components can be increased as far as 99% grass fibre fraction. The higher the grass fraction, the lower is the energy expenditure in the production of the raw material compared with conventional paper. Among other things, due to the natural colour of the grass, the material achieves a high opacity. Due to the high opacity the user of the paper can use lighter grammages without allowing translucence. In order to ensure a wide field of application, colour can be added to the material as desired, e.g. by painting, the mass or by gluing. A white fraction in line with market requirements can thus be obtained. By using the calender the surface can be additionally smoothed as desired.

EXPERIMENT 1

In this series of tests dry hay having a dry content between 75 and 85% was used. This was coarsely cleaned so that it was freed from impurities such as, for example, soil. It was then shortened to a third of the length (about 20 cm) and then washed out with warm water at about 15 degrees and wrung out in a filter. This procedure was repeated three times and a quantity of green coloration was washed out in each case. The correspondingly cleaned hay was added to a hollander still wet. Also added were fresh fibre pulp, waste paper (120 g/m$^2$ natural paper with 1.9 times volume) and an adjuvant. In a second batch filler was additionally added in order to see what influence this has on the surface and the whiteness. After suspending for twenty two minutes in the hollander, the material preparation was completed and test sheets were produced. A printing test was performed with these sheets in order to check whether the possibly lacking whiteness can be improved, for example, by means of offset printing in white. This was also successful.

EXPERIMENT 2

Dry hay from meadow grass was used in this series of tests. This was cleaned with air and thereby freed from impurities such as, for example, soil and dust and then reduced by means of a cutting unit to about one tenth of its length (about 6 cm). This shortened hay was added still dry to a hollander. Also added were fresh fibre pulp, waste paper and two different adjuvants in order, inter alia, to obtain a better surface. After suspension for about 30 minutes, the material preparation was completed. Approximately 70×100 cm sheets were produced by means of a round screen. These sheets were each transported on a felt above the drying cylinder and dried to about 35% residual moisture. In this test the paper thus produced had a grammage of about 200 g/m$^2$ or about 110 g/m$^2$. The volume was about 1.3 g/cm$^3$. The paper thus produced shows different smoothness values on the top and underside where the screen side was smoother than the top. For this mechanically produced material a printing test was performed on a four-colour offset printing machine. A four-colour motif was tested here, once with previous application of offset printing white and once without. Both variants were absolutely successful.

EXPERIMENT 3

In order to obtain a uniformly good smoothing, another test was performed. The paper from Experiment 2 was calendered with a residual moisture of about 40%, where the calender only works with the pressure of the cylinder's own weight. After this treatment the paper only has a volume of about 1.1 g/cm$^3$. Paper having a weight of about 90 g/m$^2$ and 120 g/m$^2$ was produced during this series of tests. In order to check further processing variants, printing tests were successfully completed by means of a digital printer (OKI C 3200), an HP laser printer and a Brother inkjet printer and a punch and groove test by means of a Planotigel.

The property characteristics of the papers from Experiments 2 and 3 are compared in FIGS. 10 and 11, which are hereinafter referred to respectively as Tables 1 and 2. Here the values relate to Sample 1 from Experiment 2 and Sample 2 from Experiment 3. In addition to the absolute values, Table 1 also gives the variations of the property characteristics where, as predicted, the thickness and the air permeability of the paper decrease due to the calendering and apart from the breaking force transverse, all the other values even tend to increase significantly in relation to the elongation.

Table 2 shows the optical measured values of the two papers studied, where in addition to the distinct coloration, the very high opacity value of nearly 100% can be identified.

The measured values were determined under normal conditions of 23° C. and 50% air humidity as follows:

- Air permeability according to Bendtsen: DIN-53108 (paper testing), measuring device: Gockel & Co. Model 6, test area: 31.5 mm with a measuring head weight of 267 g, measured value: ml of air per minute, measurement setting: excess pressure of 1.5 kPa (Manostat 150 mm);
- Brecht-Imset tear strength: DIN 53115, measuring device: Karl Frank, measured value: tear strength in mJ/N;
- Breaking load and elongation: ISO 527-1, 100 mm clamping length at 10 mm/min rate of elongation, measuring device: Zwick/Roell ZMART.PRO measured value: breaking load in N and elongation in % (relative to 100 mm), modulus of elasticity in the reversible range [N/mm$^2$];
- weight per unit area [g/m2] according to ISO 536, measured value: weight of a DIN-A4 sheet determined, determine area of a DIN A4 sheet.
- thickness in μm according to ISO 534, measuring device: Lehmann LDAL-03, measured value: thickness in μm

EXPERIMENT 4

In another experiment the applicability of the fibrous material system for use in magazine paper and corrugated paper was investigated. The fundamental feasibility of using grass in the said qualities was demonstrated by means of these experiments on a paper machine. For further processing and refinement experiments three rolls having different grammages each of about 100 m were fabricated for each paper quality.

Fibrous material used, magazine paper: 14% long fibre (spruce/pine)/Stendal ECF (Mercer), 33% short fibre (eucaluptus)/Cenibra, 3% CTMP (spruce/pine)/Waggeryd CTMP, 50% grass. The grass here is Southern German meadow grass that is conventionally cut for fodder use and was dried in air to about 8% residual moisture.

Additive (relative to fibrous material): 1% starch/Cargill 35844, 0.8% AKD/Akzo Nobel EKA DR 28 HF (0.5% in Experiments 6-10), 0.025% PAM/BASF-Percol 540.

Preparation of material: the defibration was carried out at a material consistency of 5%, a pulper rotational speed of 990 rpm over a time of 15 minutes. The grinding was carried out at a material consistency of 4%, a cutting angle of 60° , an edge load of 0.7 Ws/m and a grinding energy of 150 kWh/t. The dewatering resistance achieved after the grinding was an SR value of 32° .

Fibrous material used: corrugated paper comprising about 50% AP grade 1.02/50% AP Grade 1.04, 50% grass. The grass used here is also Southern German meadow grass that is conventionally cut for fodder use and was dried in air to about 8% residual moisture.

Additives (relative to fibrous material): 1% starch/Cargill 35844, 0.025% PAM/BASF-Percol 540.

Preparation of material: the defibration was carried out at a material consistency of 5%, a pulper rotational speed of 990 rpm over a time of 15 minutes.

In addition, the grass used in the aforesaid material composition was prepared as follows:

The grass was defibred at a material consistency of 10%, a pulper rotational speed of 990 rpm over a time of 20 minutes. This was followed by deflaking at a rotational speed of 2200 rpm over a time of 5 minutes. The grass was ground at a material consistency of 8%, a cutting angle of 60° , an edge load of 0.7 Ws/m and grinding energy of 25 kWh/t. After this the grass fibrous material had a dewatering resistance measured as SR value of 52° .

Figure 2:
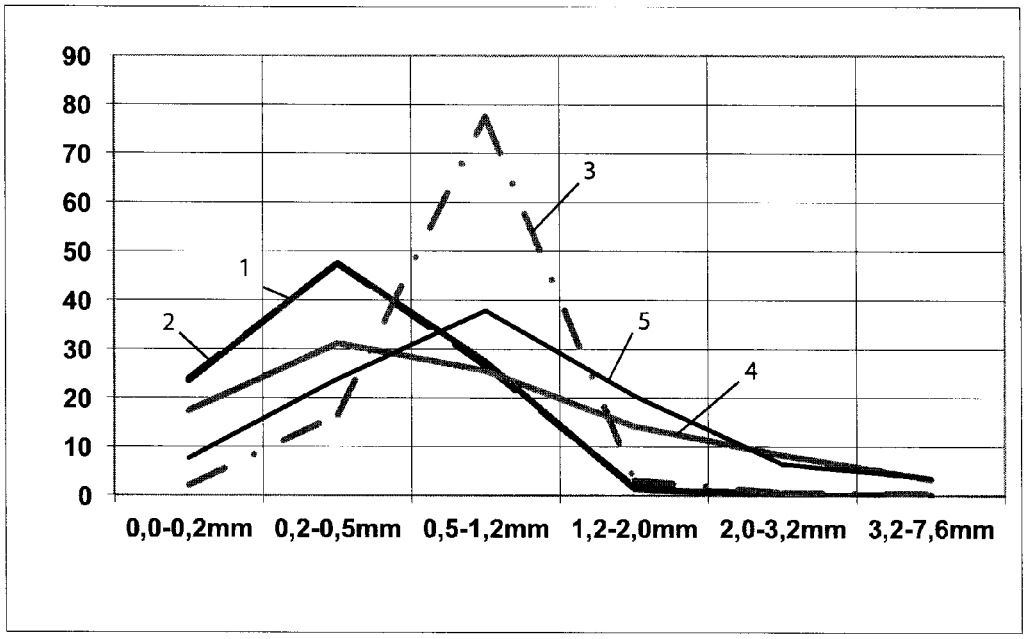
FIG. 2 shows the fibre length distribution in fibre length classes of the material systems used in this experiment and compared to other common fibrous material systems.

FIG. 2 shows the fibre length distribution in fibre length classes of the material systems used in this experiment and compared to other common fibrous material systems. Here the fibre length classes—length weighted are plotted on the x axis and the percentage fraction in the fibre length class is plotted on the y axis. Curve 1 shows the fibre length distribution of straw after defibring, curve 2 shows fibre length distribution of straw after 5 min, curve 3 shows short fibre pulp of eucalyptus, curve 4 shows grass with a dewatering resistance of 52° SR and curve 5 shows grass with a dewatering resistance of 49° SR.

Here it is shown that the two grass fibrous materials used 4 and 5 have a more homogeneous fibre length distribution compared to other fibrous material systems since the main emphasis in the length classes 0.2-0.5 mm or 0.5-1.2 mm are not so strongly defined.

Paper rolls or paper sheets having various grammages between 40 g/m$^2$ and 80 g/m$^2$ for the magazine paper and between 90 g/m$^2$ and 250 g/m$^2$ for the corrugated board line were manufactured under comparable conditions from the corresponding material systems.

Figure 3:
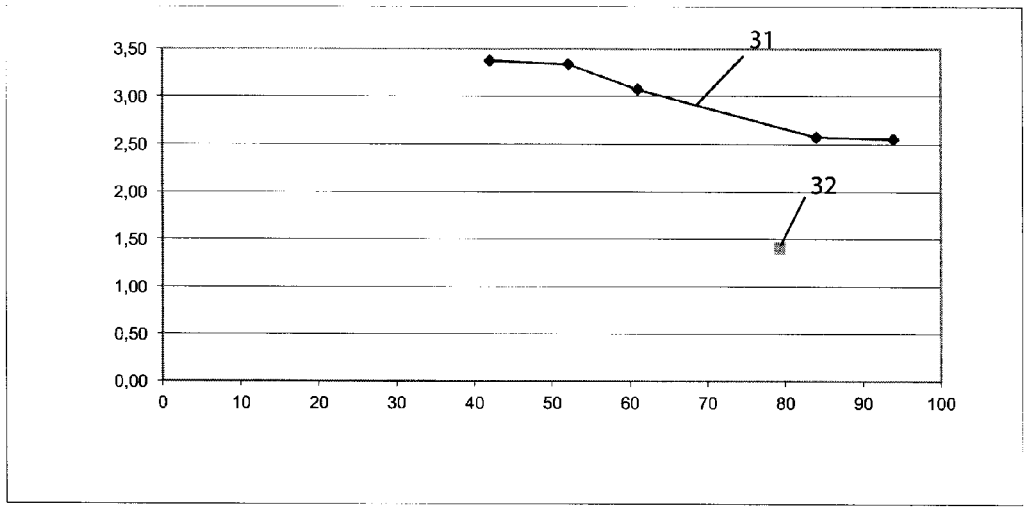
FIGS. 3-6 show the property values of corresponding magazine papers which have been manufactured from the aforesaid fibrous material system.
Figure 4:
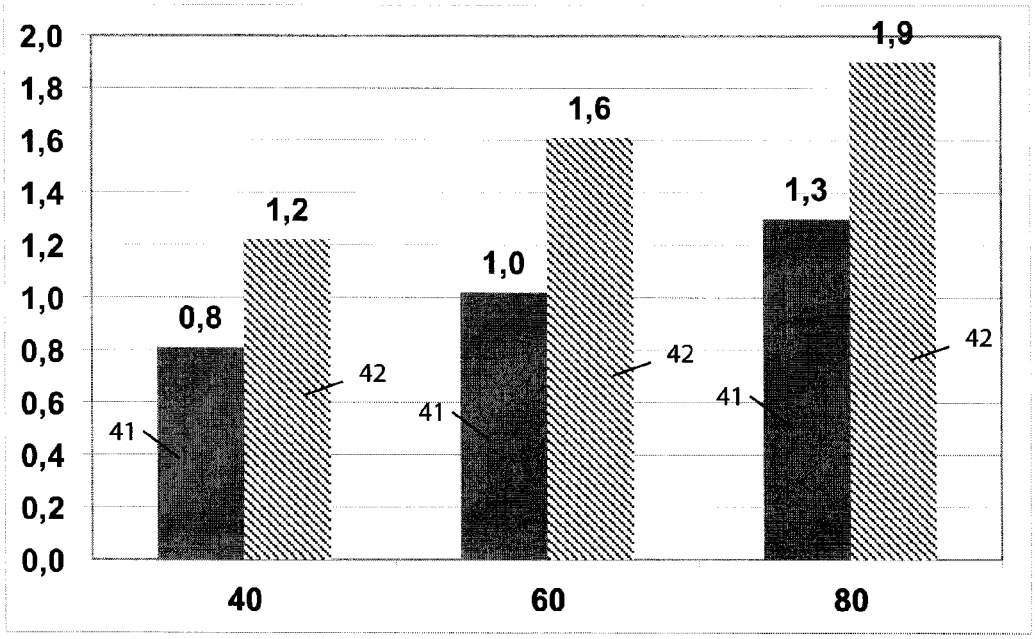
Figure 5:
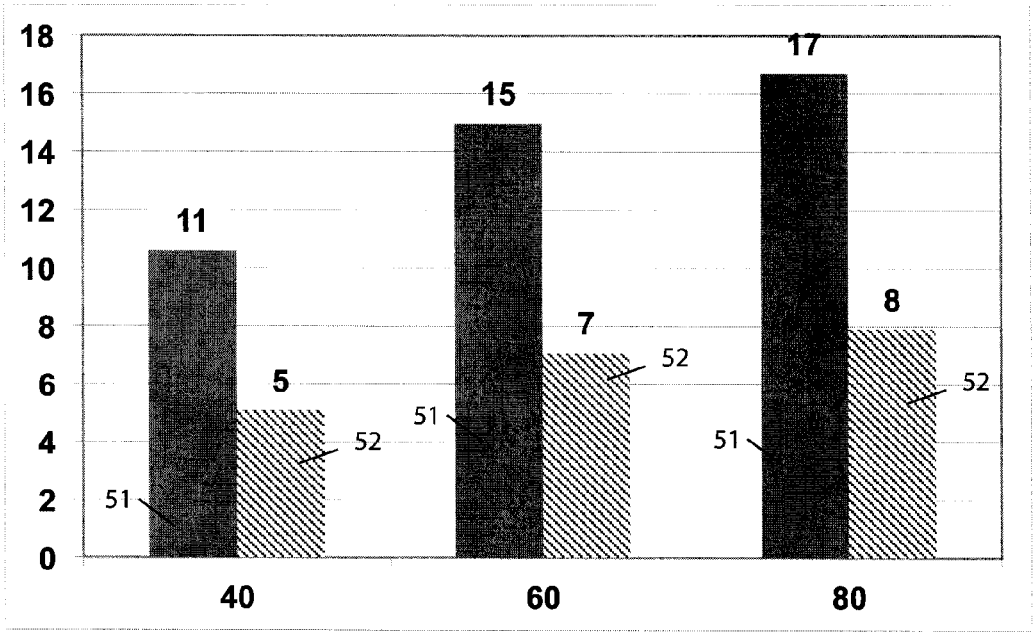
Figure 6:
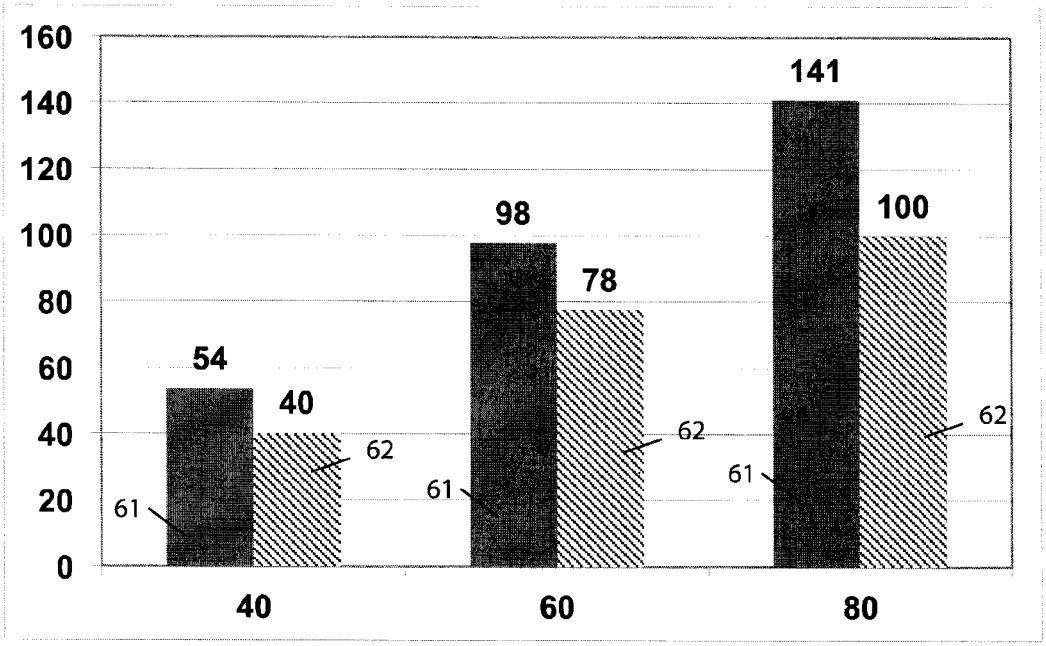

FIGS. 3 to 6 show the property values of corresponding magazine papers which have been manufactured from the aforesaid fibrous material system. FIG. 3 shows the evolution of the specific volume in cm$^3$/g (y axis) as a function of the area-related mass in g/m$^2$ (x axis) for the cellulose/grass fibrous material system 31 and a pure cellulose fibre system 32. FIG. 4 shows the longitudinal 41 and transverse 42 breaking elongation in % (y axis) as a function of the area-related mass in g/m$^2$ (x axis). FIG. 5 shows the longitudinal 51 and transverse 52 tensile strength index (y axis) as a function of the area-related mass in g/m$^2$ (x axis) and FIG. 6 shows the longitudinal 41 and transverse 42 energy absorption capacity in J/g (y axis) as a function of the area-related mass in g/m$^2$ (x axis).

Figure 7:
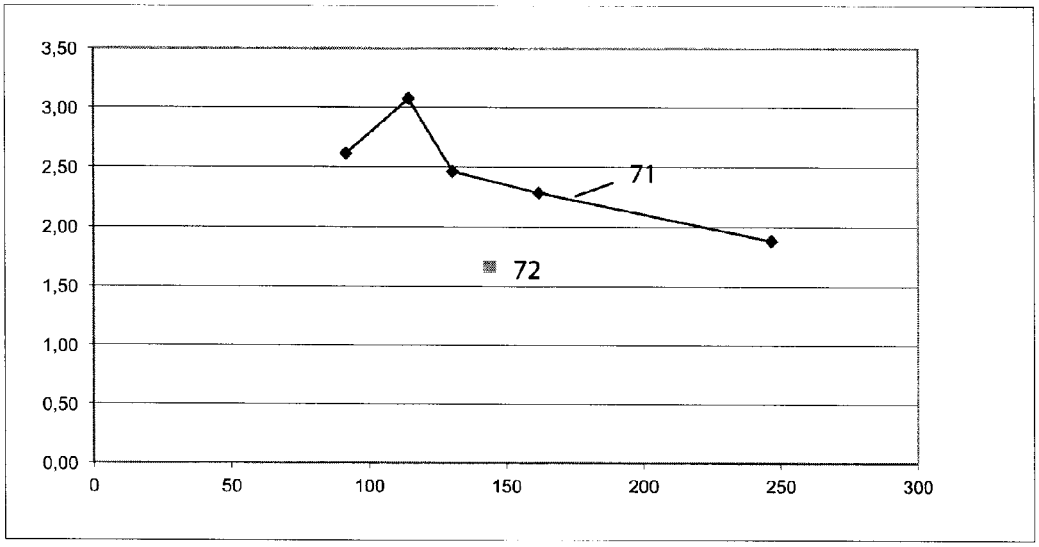
FIGS. 7-9 show the property values of corresponding corrugated board liners which have been manufactured from the aforesaid fibrous material system.
Figure 8:
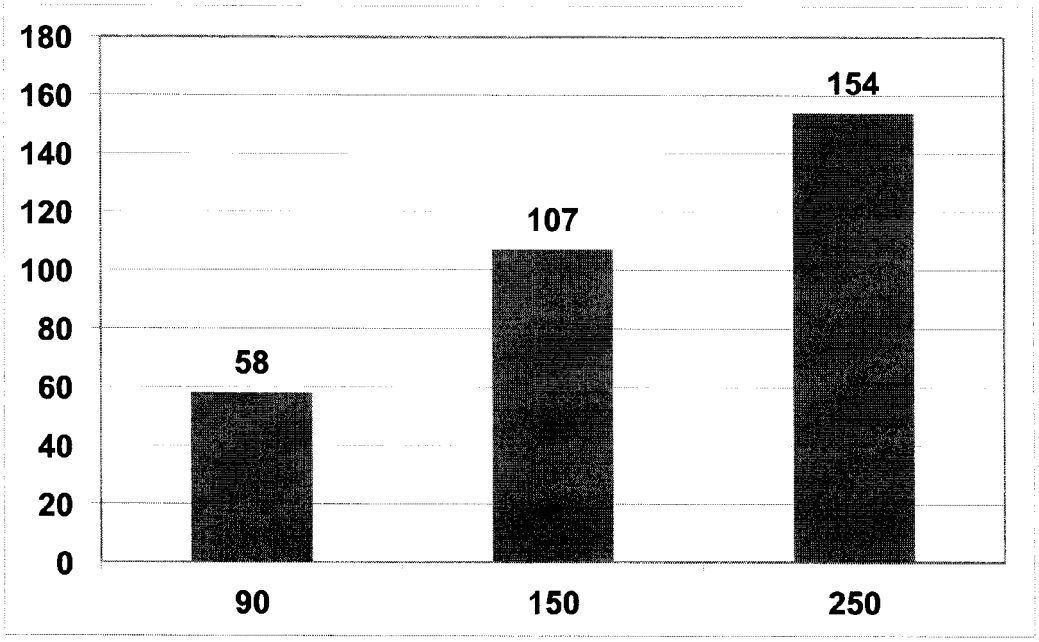
Figure 9:
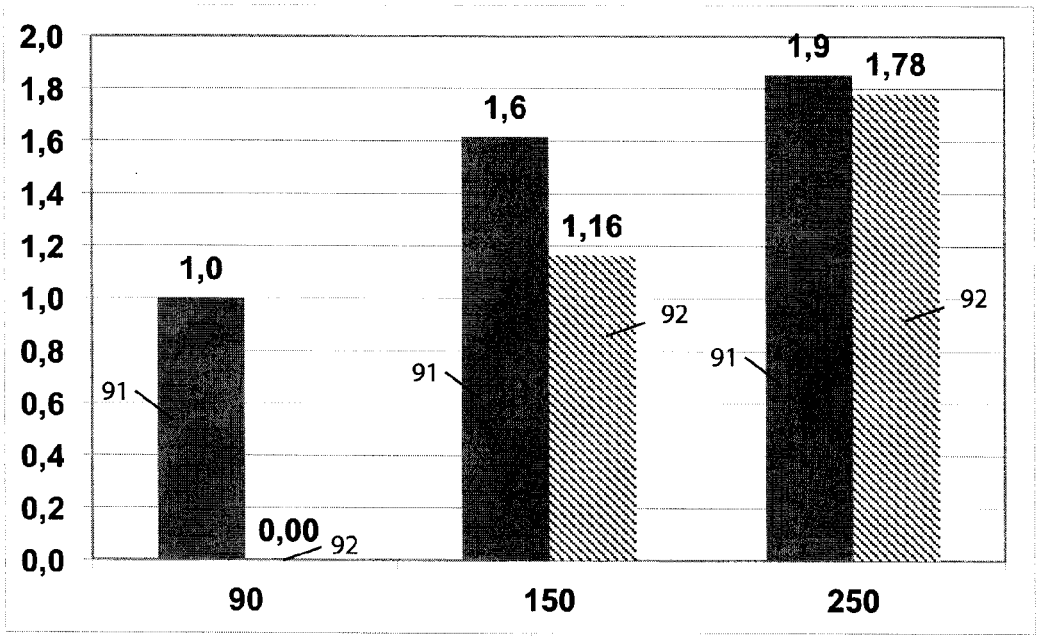

FIGS. 7 to 9 show the property values of corresponding corrugated board liners which have been manufactured from the aforesaid fibrous material system. FIG. 7 shows the evolution of the specific volume in cm$^3$/g (y axis) as a function of the area-related mass in g/m$^2$ (x axis) for a liner/grass fibrous material system 71 and a pure liner fibrous material system 72. FIG. 8 shows the (Mullen) bursting index in kPa (y axis) as a function of the area-related mass in g/m$^2$ (x axis) and FIG. 9 shows the longitudinal 91 and transverse 92 compression strength (y axis) as a function of the area-related mass in g/m$^2$ (x axis).

The results of the fibre length investigation and the fibre length distribution show a similarity with fibrous material such as, for example, fibrous material systems comprising straw. The fibrous material has a relatively large fibre diameter and a high fibre wall thickness. In particular with low weight per unit area, this has the effect of increasing the volume of the paper. The tensile strength for magazine paper is approximately at the level of wood-free unpainted paper comprising 100% short fibre cellulose with about 20% filler. The measured strengths for the liner are also at a good basic level where the higher volume has an advantageous effect on the stiffness properties.

The invention claimed is:

1. A method for producing a fibrous material composition comprising the steps:

a) harvesting at least one of sweet grass, sedge, seagrass and algae;

b) cutting the at least one of sweet grass, sedge, seagrass and algae to a predefined length between 10 mm and 1 mm;

c) after cutting, fibrillating grinding of the at least one of sweet grass, sedge, seagrass, and algae;

d) after fibrillating grinding, at least partially pelleting the at least one of sweet grass, sedge, seagrass and algae individually or in combination;

e) after at least partially pelleting, suspending the at least one of sweet grass, sedge, seagrass and algae in water; and f) adding predefined fractions of at least one of fresh fibres, waste paper and adjuvants to the suspension.

2. The method according to claim 1 wherein at least one of the sweet grass, sedge, seagrass and algae are at least partially dried individually or in combination.

3. The method according to claim 1 wherein the at least one of sweet grass, sedge, seagrass and algae is ground at least one of before and after the addition of fresh fibres and/or waste paper.

4. The method according to claim 1 further including at least one of bleaching, sorting, dispersing and homogenizing at least one component of the fibrous material composition.

5. The method according to claim 1 wherein the fibrous material composition is adjusted to a predefined material consistency before the further processing.

6. The method according to claim 1 wherein before cutting to a predefined length, the at least one of sweet grass, sedge, seagrass and algae is cleaned mechanically.

7. The method of claim 1 further including using the fibrous material composition to produce at least one of paper, board, card, print substrates, isolating or insulating material, fibre boards, filler material, and combinations thereof.

8. The method of claim 1 wherein at least one of the seagrasses and the algae are harvested and are selected from a group which includes seagrasses *zostera* and species zostera angustifolia *hornem.*rchb., zostera asiatica miki, zostera caespitosa miki, zostera capensis setch., zostera capricorni asch., zostera caulescens miki, zostera japonica asch. & graebn., common seagrass *zostera marina l.*, zostera mucronata hartog, zostera muelleri lrmisch ex asch., dwarf eel-grass *zostera noltii hornem.*, zostera novazelandica setch., zostera tasmanica m.martens ex asch., heterozostera and phyllospadix, Neptune grasses *posidonia* from the family posidoniaceae, cymodocea, halodule, syringodium and thalassodendron from the family cymodoceaceae and enhalus acoroides, halophila and thalassia from the family of the tape grass family *hydrocharitaceae* , subfamily halophiloideae, or glaucophyta, haptophyta, brown algae *phaeophyta* , red algae *Rhodophyta* , green algae *chlorophyta* , heterokontophyta, excavata, stramenopile, haptophyta, chlorarachniophyta and heterokontophyta, alveolata, biliphyta and combinations thereof.

9. The method according to claim 1, wherein at least one of the fresh fibres and the waste paper are selected from a group containing long fibre pulp, short fibre pulp, chemically delignified fibrous materials, sulphate pulp, sulphite pulp, pulps from the soda process or organocell process, cotton pulp, mechanical pulp, thermo mechanical pulp, groundwood pulp, chemo thermo mechanical pulp, waste paper, bleached cellulose, and combinations thereof.

10. The method according to claim 1 wherein at least one of the sweet grass and sedge fibres are selected from a group of grasses which includes spike grasses, meadow grasses and spiked meadow grasses as well as sedges of the genera poaceae, and cyperaceae, zea mays - maize, meadow grass, sport and utility grass, sedges of the species carex, and combinations thereof.

11. The method according to claim 1 wherein adding the predefined fractions includes mechanically preparing grass fibers.

12. The method according to claim 1 wherein a fibre component of the fibrous material composition is chemically brightened.

13. The method according to claim 1 wherein a fibre component of the fibrous material composition is bleached.

14. The method according to claim 1 wherein the adjuvants are selected from a group which includes retention agents, dewatering adjuvants, retention agent dual systems or microparticle systems, wet and dry strength agents, fillers, pigments, and combinations thereof.

15. The method according to claim 1 wherein the weight fraction of grass fibres is greater than 10%.

16. The method according to claim 1 wherein the at least one of sweet grass, sedge, seagrass and algae is ground in a fibrillating manner before or after the addition of at least one of fresh fibres and waste paper.

17. A method for producing a fibrous material composition comprising the steps:

a) harvesting at least one of sweet grass, sedge, seagrass, and algae;

b) cleaning the at least one of sweet grass, sedge, seagrass, and algae, individually or in combination, by at least one of (i) mechanically cleaning and (ii) washing with at least one of air and water;

c) cutting the at least one of sweet grass, sedge, seagrass, and algae to a predefined length between between 10 mm and 1 mm;

d) after cutting, fibrillating grinding of the at least one of sweet grass, sedge, seagrass, and algae;

e) after fibrillating grinding, pelleting the at least one of sweet grass, sedge, seagrass, and algae, individually or in combination;

f) after pelleting, suspending the at least one of sweet grass, sedge, seagrass, and algae in water; and g) adding predefined fractions of at least one of fresh fibres, waste paper, and adjuvants to the suspension.

18. The method of claim 17 further including at least partially drying the at least one of sweet grass, sedge, seagrass, and algae, individually or in combination.

19. The method according to claim 17 further including using the fibrous material composition to produce at least one of paper, board, card, print substrates, isolating material, insulating material, fibre boards, filler material, and combinations thereof.

* * * * *